US005898278A

United States Patent [19]

Müessli

[11] Patent Number: 5,898,278

[45] **Date of Patent: *Apr. 27, 1999**

[54] SERIES RESONANT LAMP CIRCUIT HAVING DIRECT ELECTRODE CONNECTION BETWEEN RECTIFIER AND AC SOURCE

[75] Inventor: Daniel Müessli, Kirchlindach, Switzerland

[73] Assignee: Pinbeam AG, Saland, Switzerland

[ * ] Notice: This patent issued on a continued prosecution application filed under 37 CFR 1.53(d), and is subject to the twenty year patent term provisions of 35 U.S.C. 154(a)(2).

[21] Appl. No.: 08/513,039

[22] Filed: Aug. 9, 1995

[51] Int. Cl.[6] ..... H05B 37/02

[52] U.S. Cl. ..... 315/209 R; 315/278; 315/219; 315/224; 315/307; 363/17

[58] Field of Search ..... 315/DIG. 7, 209 R, 315/224, 219, 278, 307, 324; 363/17, 37, 98

[56] References Cited

U.S. PATENT DOCUMENTS

| | | | |
|---|---|---|---|
| 4,525,650 | 6/1985 | Hicks et al. | 315/DIG. 7 |
| 4,544,863 | 10/1985 | Hashimoto | 315/DIG. 7 |
| 4,581,562 | 4/1986 | Nilssen | 315/DIG. 7 |
| 4,749,909 | 6/1988 | Smulders | 315/106 |
| 5,122,712 | 6/1992 | Hirschmann | 315/106 |
| 5,138,235 | 8/1992 | Sun et al. | 315/DIG. 7 |
| 5,475,284 | 12/1995 | Lester et al. | 315/209 R |
| 5,488,269 | 1/1996 | El Hamamsy et al. | 315/209 R |
| 5,512,801 | 4/1996 | Nilssen | 315/209 R |
| 5,559,394 | 9/1996 | Wood | 315/DIG. 7 |

FOREIGN PATENT DOCUMENTS

| | | | |
|---|---|---|---|
| 2038572 | 7/1980 | United Kingdom | 315/106 |

*Primary Examiner*—Michael Shingleton
*Attorney, Agent, or Firm*—Rothwell, Figg, Ernst & Kurz

[57] ABSTRACT

For driving gas discharge lamps, a ballast is provided between the positive and the negative output terminals of a rectifier arrangement (D1, D2, D3, D4). The ballast comprises a filter stage (C1, C2, C3, DR1, DR2) with an oscillation voltage build-up circuit (R1, C6, D5, DIAC) and with a high-frequency resonant circuit (R2–R6, T1, T2, D5, D6, C6, I1, I2), and also with a decoupling capacitor (C7), a third inductor (DR3) and a third inductance (I3, I4). This third inductance is wound together with the two abovementioned windings of the high-frequency resonant circuit (I1, I2) onto a common core. The ballast is routed by a connecting line (VL) from the junction (H) between the two transistors (T1, T2) to one electrode (E1) of the discharge lamp (FL), the second electrode (E2) of which is connected to the first electrode (E1) via a resonant capacitance (C12, C13). There is provided in the circuit between the connecting line (VL) and the connection of the discharge lamp (FL) to the rectifier (D1, D2, D3, D4) a series resonant circuit having an inductance (DR3, I4) and a capacitance (C8) for limiting the current and for building up a voltage potential of the high-frequency supply of the discharge lamp (FL) in order to activate the diodes (D1, D2, D3, D4) in the rectifier. The result of this is that the reactive current component is almost zero and the voltage spikes are virtually suppressed on the mains side.

7 Claims, 5 Drawing Sheets

SERIES RESONANT LAMP CIRCUIT HAVING DIRECT ELECTRODE CONNECTION BETWEEN RECTIFIER AND AC SOURCE

BACKGROUND OF THE INVENTION

1. Field of the Invention

The present invention relates to a circuit arrangement for driving gas discharge lamps having a ballast between the positive and the negative output terminals of a rectifier arrangement connected to an AC mains voltage supply through a phase conductor and a neutral conductor, which ballast is equipped with a filter stage, an oscillation voltage build-up circuit, an oscillation inverter having two transistors driven by first and second windings of a current transformer a high-frequency resonant circuit, and also with a decoupling capacitor and a third winding which, having been wound together with the two abovementioned windings of the high-frequency resonant circuit onto a common core, form a current transformer, and which ballast is routed by a connecting line from the junction between the two transistors to one electrode of the discharge lamp.

2. Background and Prior Art

Electrical ballasts for fluorescent lamps have been known for a long time. They are used to raise the mains voltage of usually 110 or 220–250 volts to a substantially higher ignition voltage which may be in the order of magnitude of about 1000 volts. It is also known to raise the frequency of the usual mains frequency of 50 or 60 Hz to a higher frequency which may be from 30 to 40 kHz. These measures have the advantage that the lamp can ignite immediately when turned on.

It is required of the electricity suppliers that, on the one hand, the harmonics do not occur in the radiofrequency range, which would be the case with the third harmonic at 150 kHz if the frequency of the lamp supply voltage were 50 kHz. Consequently, the frequency must be <50 kHz, but for operation it should be >25 kHz. On the other hand, the reactive current is also very problematic, because the measurement and hence the billing are difficult.

A further problem is posed by the peak voltages of the high frequency, because their spikes are super-imposed on the oscillations of the mains voltage. These problems can be solved if, in accordance with DE-A-36 11 611, inductors are connected into the supply line. However, this has the disadvantage that such inductors have to be relatively large at the mains frequency of 50–60 Hz and, consequently, can in no way be built into the lamp stand of a power-saving lamp. In order to reduce the harmonics, DE-A-32 22 534 has proposed a series circuit of an inductor and a diode with two capacitors at the junction point of those two elements. This arrangement leads to a reduction in the harmonics. However, these elements form a high-frequency divider, as a result of which the transistors are heavily loaded. This additional inductor is thus part of the high-frequency resonant circuit and therefore only partially effects interference suppression, with the result that the harmonics are nevertheless higher than permitted, and, moveover, the reactive current component cannot be reduced in this way.

SUMMARY OF THE INVENTION

Accordingly, an object of the invention is to provide a circuit arrangement in which the reactive current component is almost zero and the voltage spikes on the mains side are virtually suppressed.

This is achieved in accordance with the features of the invention by the fact that there is provided in the circuit connection of the discharge lamp to the rectifier a series resonant circuit having an inductance and a capacitance for limiting the current and for building up a voltage potential of the high-frequency supply of the discharge lamp in order to turn on the diodes in the rectifier.

BRIEF DESCRIPTION OF THE DRAWINGS

Exemplary embodiments of the invention are explained in more detail below using the drawing, in which.

DETAILED DESCRIPTION OF THE PREFERRED EMBODIMENTS

Figure 1:
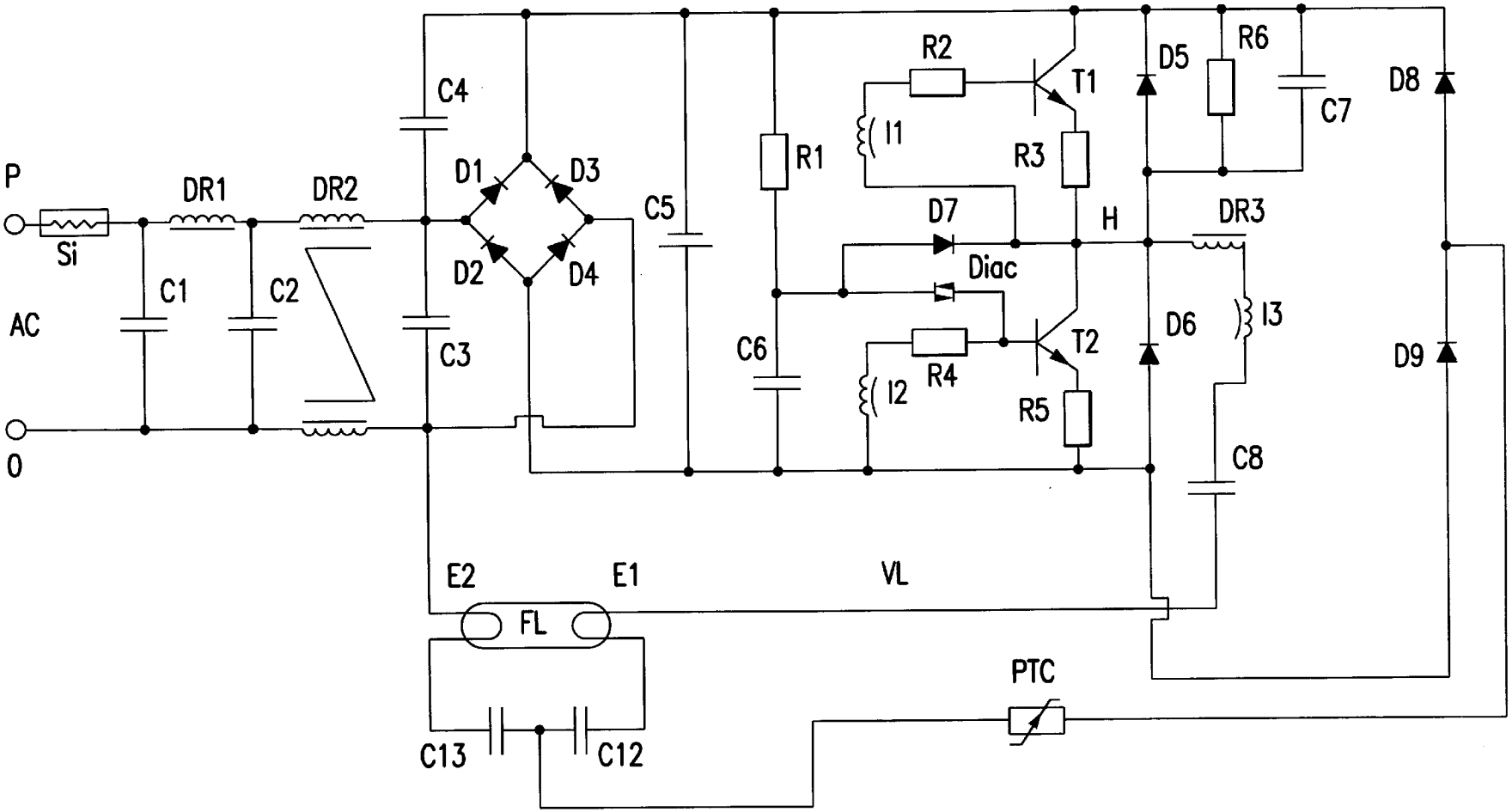
FIG. 1 shows a complete circuit diagram of an arrangement for operating a power-saving lamp with feedback from the lamp to the mains side of the rectifier.

The circuit arrangement in accordance with FIG. 1 for driving a discharge lamp FL illustrates a voltage supply AC from an AC source having a mains voltage of 220 V and a frequency of 50 to 60 Hz connected between a frequency of phase conductor P and neutral conductor O. A fuse Si protects the circuit from high currents. Diodes D1, D2, D3 and D4 form a rectifier bridge circuit of known arrangement with an inductor DR1 and a current-compensated filter inductor DR2 and compensation capacitors C1, C2, C3 being provided between supply AC and the bridge rectifier. An electrolytic capacitor C5 serves as a smoothing capacitor.

The circuit arrangement further includes a push-pull frequency generator having two inverter transistors T1 and T2, and two freewheeling diodes D5 and D6 which, together with resistor R6 and capacitor C7, stabilize the frequency of a high-frequency resonant circuit for the discharge lamp. In this case, the capacitor C7 controls the rise characteristic of the transistors T1 and T2. Bias resistors R2 and R4 and emitter resistors R3 and R5 are provided for proper operation of the transitors. The coupling capacitor C4 is used to control the rising edge of the rectifier bridge circuit formed of diodes D1, D2, D3 and D4. An oscillation voltage build-up circuit comprises a resistor R1 and a capacitor C6, a diode D7 and a Diac, and ensures that the high-frequency resonant circuit with a first winding I1 in series with base resistor R2 and a second winding in series with base resistor R4 is made to oscillate in known manner when the mains voltage AC across the terminals P and O is turned on. The two windings I1 and I2 are wound onto a common annular core.

The power-saving discharge lamp FL is connected by first electrode E1 to the junction point H between the two transistors T1 and T2 via a connecting line VL including a further inductor DR3, a third winding I3 and a capacitor C8.

The other electrode E2 of lamp FL is connected to the neutral conductor O of the AC voltage AC. The series resonant circuit comprises the resonant inductance of the inductor DR3, the coupling capacitor C8 and the resonant capacitor C7. In this case, the resonant inductance DR3 and the coupling capacitor C8 between the said junction points between the transistors T1, T2 and the electrode E1 of the lamp FL and the resonant capacitor C7 are connected into the heating circuit of the lamp FL. The mode of operation of the push-pull frequency generator together with the series resonant circuit for operating the lamp does not have to be mentioned here separately since, on the one hand, it is known to any person skilled in the art and, on the other hand, it is described in the book "Elektronik-Schaltungen [Electronic Circuits]" by W. Hirschmann (Siemens Aktiengesellschaft) p. 148.

Two further diodes D8 and D9 are connected across the high-frequency resonant circuit with the transistors T1, T2 and the freewheeling diodes D5, D6, the junction point of which diodes D8 and D9 is connected via a thermistor PTC to the junction point between two capacitors C12, C13 which bridge the electrodes E1 and E2 of the discharge lamp FL. This arrangement effects preheating of the discharge lamp.

When the ballast is turned on, the thermistor PTC is generally cold and therefore has a low resistance. In order to prevent a corona discharge from being produced in the discharge lamp in this switching state as a result of a high voltage between the electrodes E1, E2, the capacitors C12, C13 must have a relatively high capacitance, typically about 6 nF. In this state, a current of about 100 mA flows through the output circuit of the ballast, as a result of which current the filaments of the electrodes E1, E2 and the thermistor PTC are heated in seconds to about 900° C. This has the effect that the thermistor PTC develops a high resistance, so that the voltage across the electrodes E1, E2 increases to 1000 V, as a result of which the discharge lamp FL ignites without a corona discharge. When the discharge lamp has ignited, the voltage then breaks down to about 100 V. When the discharge lamp has ignited, in order that the thermistor PTC does not now constantly consume a power of about 0.5 W, the preheating circuit is separted from the supply current of the discharge lamp, by drawing the supply current of the discharge lamp from the junction point H once the lamp FL has ignited, creating a current flow between electrodes E1 and E2. The ignition operation is as described above, but, because of the diodes D8, D9, no more current flows via the thermistor PTC once the discharge lamp has ignited, and thus the thermistor cools down again. An unnecessary power consumption by the thermistor PTC is thus avoided.

This arrangement can be utilized even further if a series circuit formed by inductance I3 and capacitor C8 is connected into the connecting line VL between the junction point H and the electrode E1. As a result of the feedback of the second electrode E2 to the supply rectification, as shown in FIG. 1, on the AC side upstream of the rectifier D1, D2, D3, D4, it is the current is limited and a voltage potential is built up in the high-frequency supply of the discharge lamp FL in order to turn on the diodes (D1, D2, D3, D4) in the rectifier. As a result, the peaks of the high-frequency voltage cannot exceed the sinusoidal oscillation of the AC current and no voltage spikes can be superimposed on the AC voltage.

This clearly shows that a substantial improvement in the operation of discharge lamps can be achieved by means of the invention proposed. The circuit elements are not substantially increased in comparison with the known arrangements, since the inductance I3 is provided as a further winding on the annular core with the windings I1 and I2, with the result that only one capacitor C8 is additionally necessary.

Figure 2:
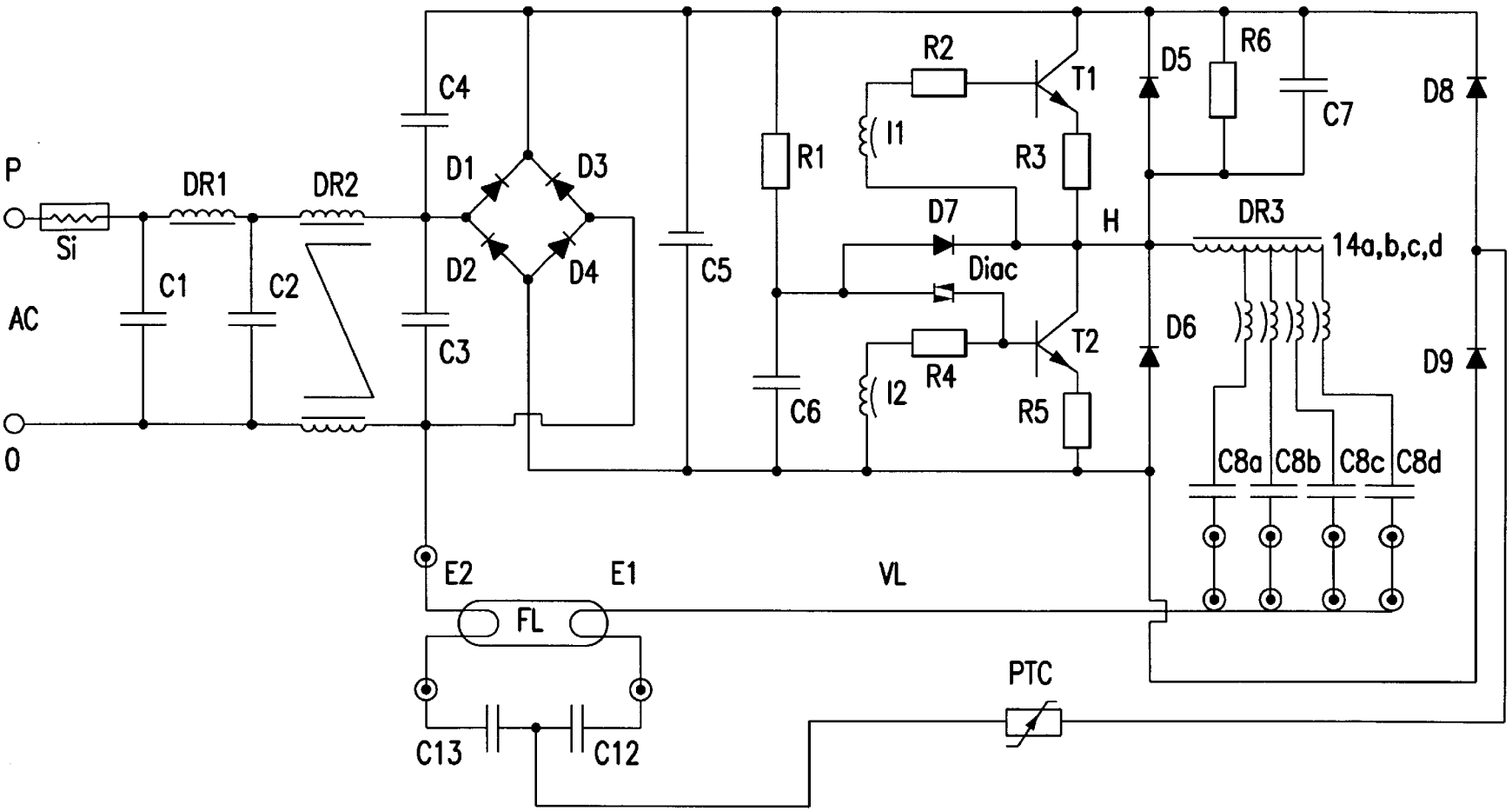
FIG. 2 shows the same circuit arrangement as in FIG. 1 with a variant of the series resonant circuit for the operation of discharge lamps of different power using the same ballast.

In accordance with the embodiment of FIG. 2, it is possible to use any wattage power-saving lamp with one and the same base, which contains the electronics in accordance with FIG. 1. To this end, it is envisaged to provide four different taps on the inductor DR3 and to subdivide the inductance I3 of the series circuit into four partial windings I4*a*, I4*b*, I4*c* and I4*d*. Of course, four different capacitances C8*a*, C8*b*, C8*c* and C8*d* are then necessary as well.

Figure 3:
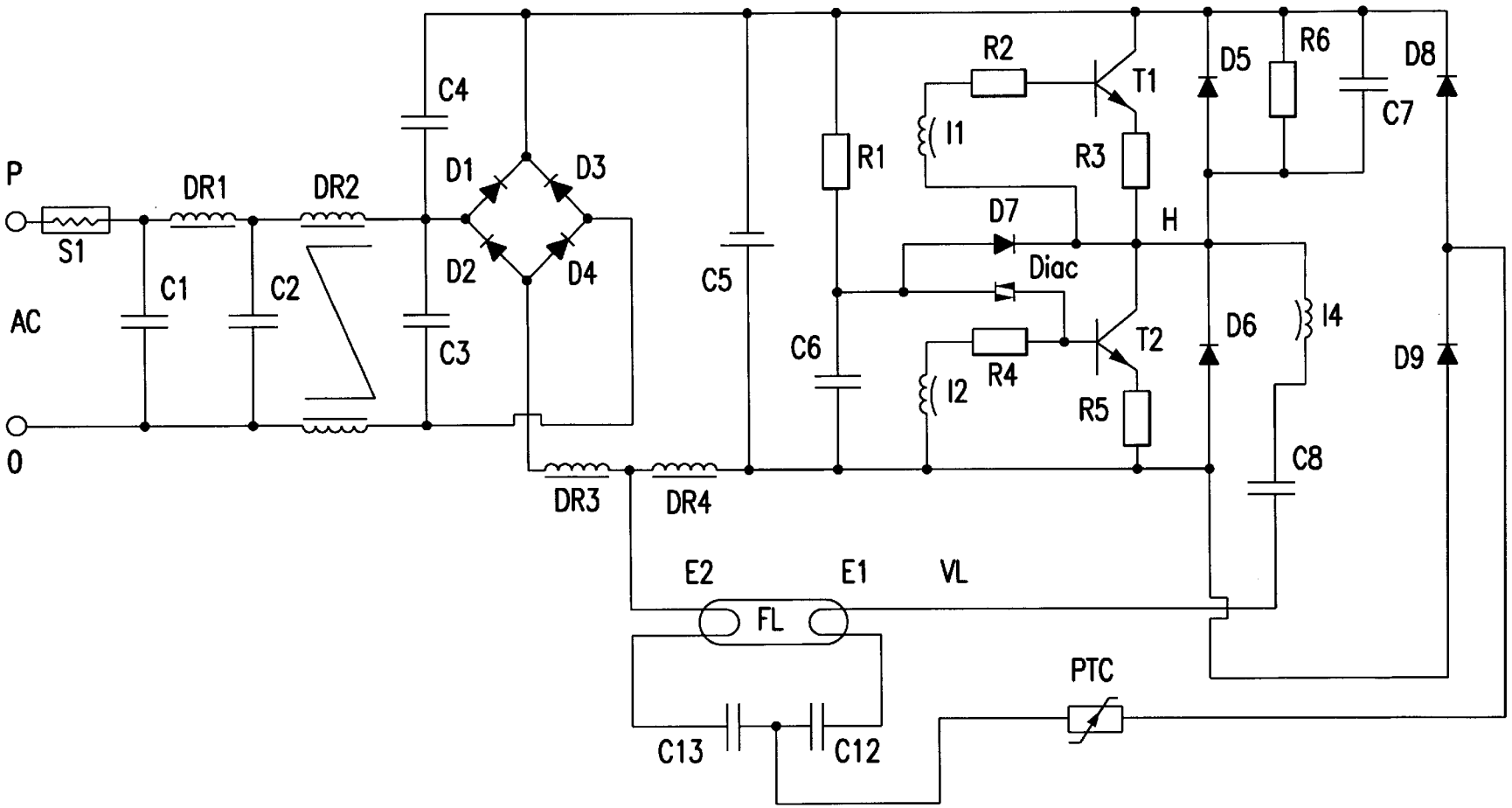
FIG. 3 shows the same circuit arrangement as in FIG. 1 but with the discharge lamp within the series resonant circuit and with the connection of said lamp by means of the second electrode on the DC side.

FIG. 3 illustrates a further variant. In this case, the inductor DR3, which was upstream of the beginning of the series circuit in FIG. 1, is no longer situated in the connecting line VL and hence in the circuit to the electrode E1, but rather in the circuit of the electrode E2, to be precise in the positive current path of the rectifier D1, D2, D3, D4. Together with a further inductor DR4, the inductor DR3 forms the DC supply for the high-frequency generator. The electrode E2 is connected to the junction point of the two inductors DR3, DR4. The mode of operation is fundamentally the same as described above, except that in this case the diodes in the rectifier are charged on the DC side.

Figure 4:
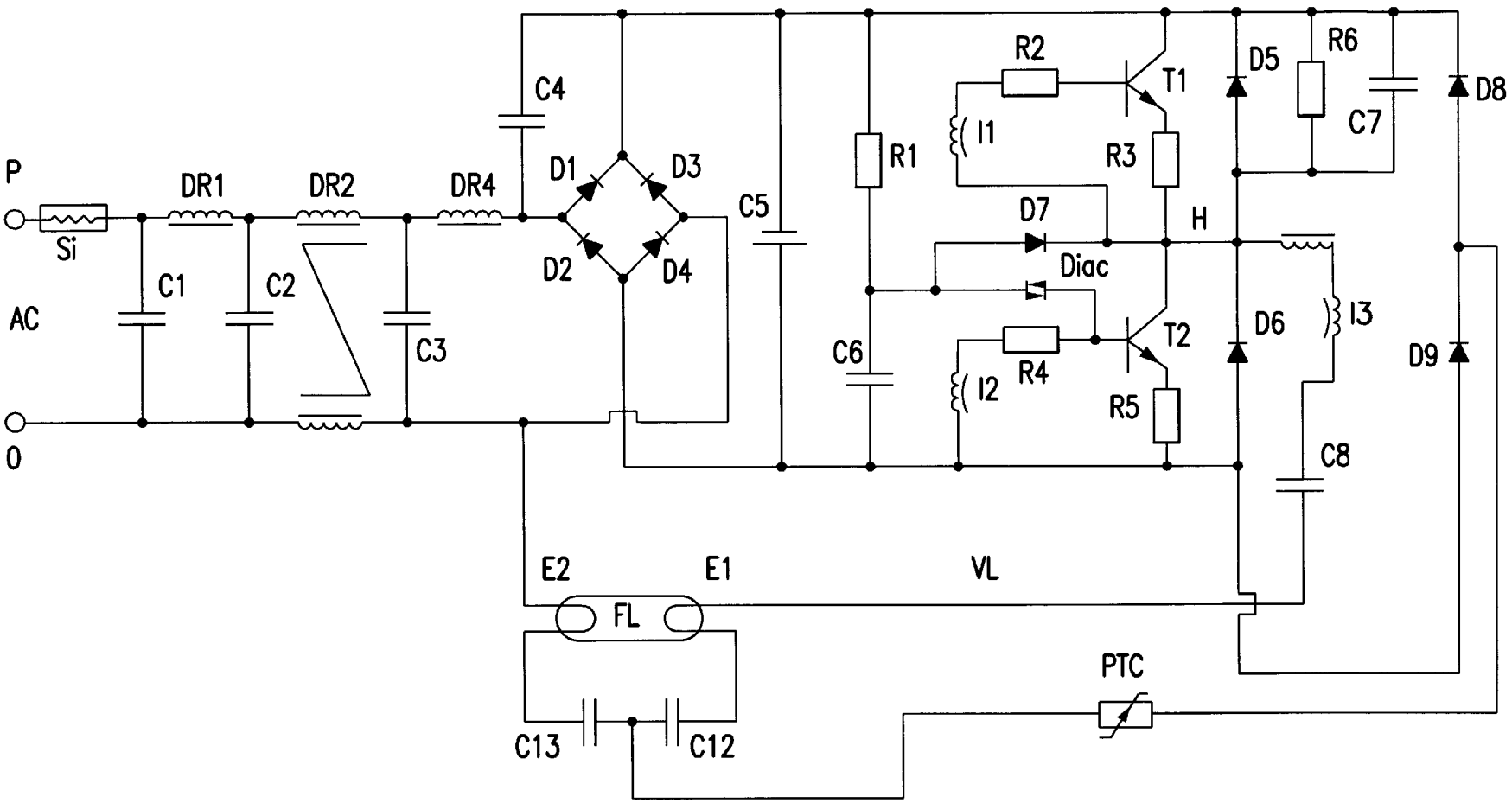
FIG. 4 shows the same circuit arrangement as in FIG. 1 but with the second electrode connected on the AC side and with an arrangement for defining the rising edge of the rectifier.

FIG. 4 shows still another variant. In this case, the design in accordance with FIG. 1 is supplemented by a fourth inductor DR4. This inductor DR4 is situated in the AC supply line between the connections of the compensation capacitor C3 and the coupling capacitor C4. As a result, with virtually the same outlay, the ratio of active power to apparent power is increased to above 0.95 and the harmonics reacting upon the AC mains are reduced to less than 10%. It was possible to measure a power factor of 99.5 and above in laboratory experiments.

This is the effect of the high-frequency oscillating current which is fed back to the AC supply via the inductor DR3, the capacitor C8 and the fluorescent lamp FL and by which the inductor DR4 is compelled to oscillate. The capacitor C4 for forming an actual resonant circuit together with the inductor DR4 can, accordingly, be connected between an AC conductor O or P and the corresponding DC connection of the rectifier D1, D2, D3, D4, but alternatively it could also be omitted, because the inductor DR4 oscillates anyway due to the high-frequency current fed back via the line VL. This forced oscillation in the AC connection is likewise rectified in the rectifier D1, D2, D3, D4 and effects modulation of the high-frequency current by the mains frequency of the AC connection, as a result of which the undesired current spikes in the AC current are eliminated.

Figure 5:
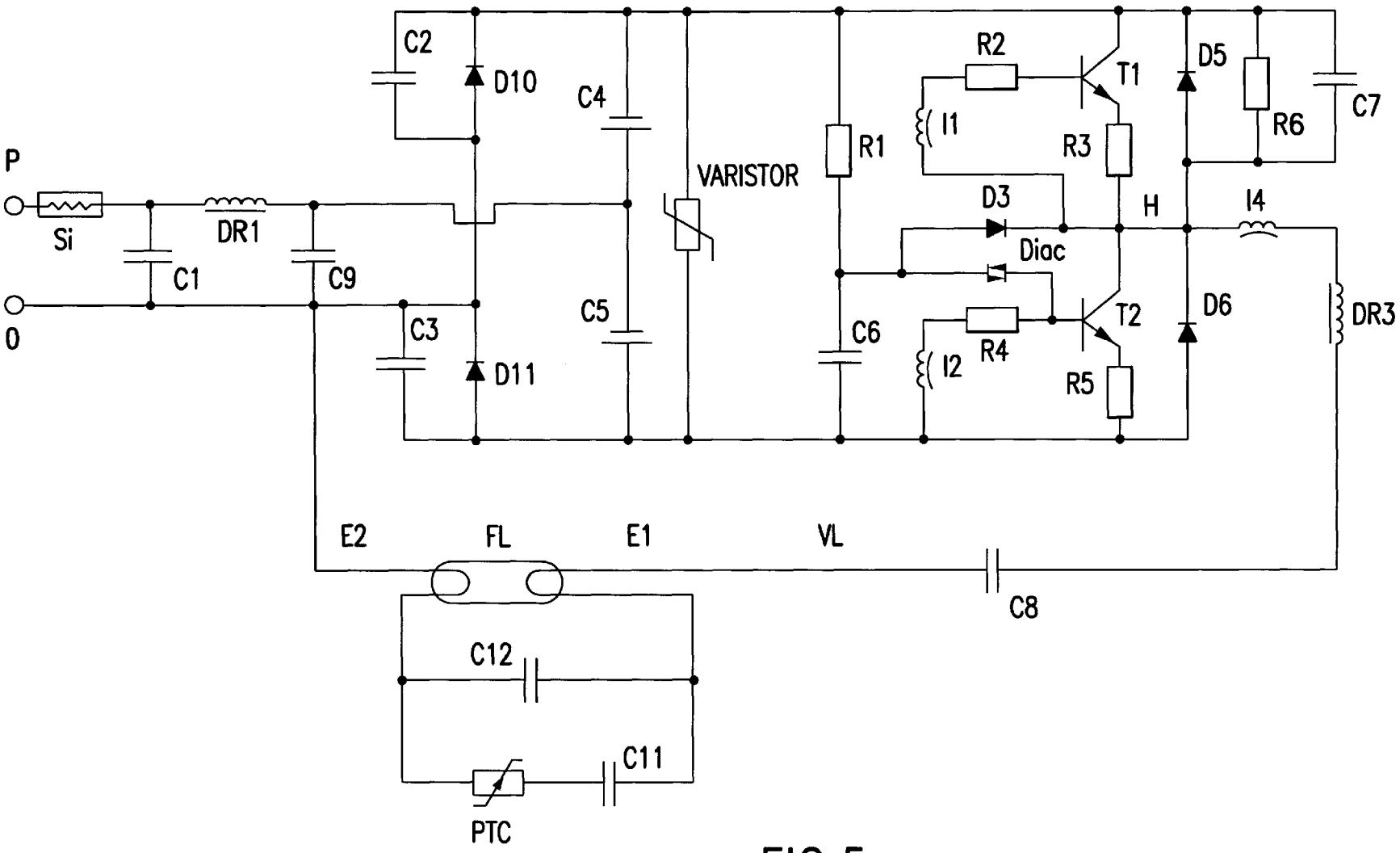
FIG. 5 shows a circuit arrangement similar to that in accordance with FIG. 1 but for a supply voltage of 110 V.

For the sake of completeness, FIG. 5 shows a circuit arrangement which has fundamentally the same structure as the previously described arrangements, except that in this case a voltage doubler circuit having diodes D10 and D11 in conjunction with the capacitors C2 and C3 is illustrated instead of the full-wave rectification with four diodes. The smoothing .of the AC current is effected by two electrolytic capacitors C4 and CS which are each connected across the DC output from the diodes D10 and D11 and the phase line P of the mains supply AC. The electrode E2 is, of course, connected on the AC side. The mode of operation is the same as in the abovementioned arrangements in that here, too, the high-frequency voltage can only reach the respective level of the instantaneous amplitude of the AC voltage, with the result that no or only very slight distortion by harmonic oscillations is possible.

I claim:

1. A circuit arrangement for driving a gas discharge lamp, comprising:

a rectifier circuit connected to an AC voltage supply through a pair of conductors;

a high-frequency resonant circuit coupled to said rectifier circuit for providing a high frequency voltage supply, comprising at least a pair of oscillation transistors connected in series with each other, and a series resonant circuit including an inductor and a capacitor connected at one end thereof to a junction between said transistors; and a gas discharge lamp having a pair of electrodes, one electrode of said gas discharge lamp being connected directly to one of said conductors without being connected through said rectifier circuit, and the other electrode of said lamp being connected to the other end of said series resonant circuit;

said series resonant circuit functioning to limit current flowing through said gas discharge lamp and to build up a voltage potential of said high frequency voltage supply which acts to turn on diodes of said rectifier circuit to prevent high frequency voltage peaks of said high frequency voltage supply from being superimposed as spikes on said AC voltage supply.

2. A circuit arrangement as set forth in claim 1, further comprising an additional inductor connected at one end thereof to said one electrode of said lamp, and at the other end thereof to said one of said conductors through said rectifier circuit.

3. A circuit arrangement as set forth in claim 1, wherein said inductor and said capacitor of said series resonant circuit arc constructed as multiple parallel-connected inductors and capacitors connected between said junction of said transistors and said other electrode of said lamp, and further including means for selectively connecting said other electrode of said lamp to said multiple parallel-connected inductors and capacitors.

4. A circuit arrangement as set forth in claim 1, further comprising a preheating circuit for preheating said electrodes of said gas discharge lamp, said preheating circuit comprising a pair of capacitors connected in series across said electrodes, a pair of diodes connected in series between output terminals of said rectifier circuit, and a thermistor connected between a junction of said pair of capacitors and a junction of said pair of diodes.

5. A circuit arrangement as set forth in claim 1, further comprising a preheating circuit for preheating said electrodes of said gas discharge lamp, said preheating circuit comprising a parallel connection of a first capacitor with a series connected thermistor and second capacitor coupled across said electrodes of said gas discharge lamp.

6. A circuit arrangement as set forth in claim 1, wherein said rectifier circuit comprises a full-wave bridge rectifier.

7. A circuit arrangement as set forth in claim 1, wherein said rectifier circuit comprises a voltage doubler.

* * * * *